US007567267B2

(12) United States Patent
Barron

(10) Patent No.: US 7,567,267 B2
(45) Date of Patent: Jul. 28, 2009

(54) SYSTEM AND METHOD FOR CALIBRATING A BEAM ARRAY OF A PRINTER

(75) Inventor: Rodolfo Jodra Barron, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 176 days.

(21) Appl. No.: 11/496,879

(22) Filed: Jul. 31, 2006

(65) Prior Publication Data

US 2008/0024586 A1 Jan. 31, 2008

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/233–235, 347/240, 248–254, 19, 112, 116, 5, 229; 399/72; 707/104.1; 358/3.26, 1.9; 101/171
See application file for complete search history.

(56) References Cited

U.S. PATENT DOCUMENTS 5,642,202 A 6/1997 Williams et al.
5,748,223 A 5/1998 Ito
6,411,322 B1 6/2002 Stanich
6,529,616 B1 * 3/2003 Rasmussen et al. ..... 382/112
6,654,041 B2 11/2003 Takesue
6,819,352 B2 * 11/2004 Mizes et al. ..... 347/240
6,831,672 B2 12/2004 Maeda
6,839,074 B2 1/2005 Takesue
7,003,241 B1 * 2/2006 Kobayashi et al. ..... 399/72
7,193,640 B2 * 3/2007 Egan ..... 347/171
7,207,645 B2 * 4/2007 Busch et al. ..... 347/19
7,419,230 B2 * 9/2008 Tatsuta et al. ..... 347/5
2002/0043164 A1 * 4/2002 Kajiwara et al. ..... 101/171
2003/0058898 A1 3/2003 Beier
2003/0128401 A1 7/2003 Conrow et al.
2004/0012819 A1 * 1/2004 Nakashige et al. ..... 358/3.26
2005/0160115 A1 * 7/2005 Starkweather ..... 707/104.1
2005/0243120 A1 11/2005 Detmers
2006/0001911 A1 * 1/2006 Viassolo et al. ..... 358/3.26
2006/0285134 A1 * 12/2006 Viturro et al. ..... 358/1.9

FOREIGN PATENT DOCUMENTS

DE 10215694 10/2003

* cited by examiner

*Primary Examiner*—Hai C Pham

(57) ABSTRACT

A system and method are provided for calibrating a beam array of a printer. The method includes the operation of printing a dot pattern using the beam array of the printer. The dot pattern can then be scanned into an electronic file using an optical scanner. Another operation is calculating distance calibration errors found in the dot pattern in the electronic file using a software module applied to the electronic file.

20 Claims, 5 Drawing Sheets

Beam Spacing estimation pattern

Scanned image

SYSTEM AND METHOD FOR CALIBRATING A BEAM ARRAY OF A PRINTER

BACKGROUND

Laser printing directs beams of laser light to a photoconducting drum in order to electro-statically charge the surface of the drum. The laser illuminated drum regions electrostatically attracts toner particles which are subsequently transferred to a piece of paper using mechanical pressure and heat. Thus, the laser illuminated drum regions generally correspond to the printed matter on the paper.

Laser printers print images by scanning a laser beam using a polygonal mirror that rotates at high speed. The printing speed may be determined, in part, by the laser beam scanning speed, which depends on the rotational speed of the polygonal mirror. However, along with faster printing speeds, the demanded rotational speed of the motor that rotates the polygonal mirror is also increasing year by year, but the rotational speed of the motor is starting to hit the point of diminishing returns. Therefore, other technologies are being developed to achieve even higher printing speeds.

As laser printing speeds increase and print resolution becomes higher, faster laser beam scanning speeds are being demanded. Multi-beam laser diode components can increase the effective scanning speed by scanning multiple lines onto the drum surface in a single pass. Current technology employs anywhere from four to twelve laser beams or more per print head.

Multi-beam laser diodes emit multiple laser beams from a single semiconductor device. By using quad-beam or twelve-beam laser diodes, the printing speed can theoretically be increased up to 4 times or 12 times (or higher) as compared to previous scanning speeds.

FIG. 1 is a diagram illustrating the operation of a multi-beam laser diode system. The diagram illustrates a laser array that is used to expose the photoconductor drum. The illustrated laser array contains 12 emitters.

The beam from each emitter is moved across the page to expose the rows of the image. The beam is switched on when a dot is desired to be developed on the page. A set of twelve rows from the image (called a swath) is exposed simultaneously. When the beam reaches the side of the page, it returns to the other side to start scanning again. The photoconductor has advanced, so the next twelve rows (or swath two) will be exposed.

In the laser printing or image forming systems that employ multi-beam systems, it is beneficial to control the write timings of each of the light beams used to write the images on the photoconductive drum or body. In other words, it is preferred if the write start positions, write timings, and spacing of each of the light beams on the photoconductive body or drum accurately match.

Sometimes a beam detector is provided outside an effective scan region of the plurality of light beams, and one (or more) of the plurality of light beams is controlled so that this selected light beam passes the beam detector in an "on" state. Electrical modulating signals are generated to modulate the plurality of light beams, based on an output of the beam detector. The modulating signals are delayed and controlled depending on the arrangements of the plurality of light beams, so that positions and timing of the plurality of light beams match on the recording medium.

The other parameter which is desired to be controlled is the vertical distance between laser emitters, which will determine the accuracy of the vertical position of the printed dot. In general, each light emitting position of the semiconductor laser array may be positioned with relative accuracy during the production process of the beam recording apparatus. However, due to inconsistencies introduced by processing errors, optical magnification errors, and assembling errors of components (e.g., the light source, photoconductive body, etc.) slight errors may introduced into the optical magnification from the light source to the photoconductive body. Errors in drum rotation speed can also exist. These errors may be unique to each machine and are generally unpredictable before assembly of a model is complete. These errors can make it difficult to accurately provide the highly accurate output that is desired in high quality imaging and printing devices.

DETAILED DESCRIPTION

Figure 1:
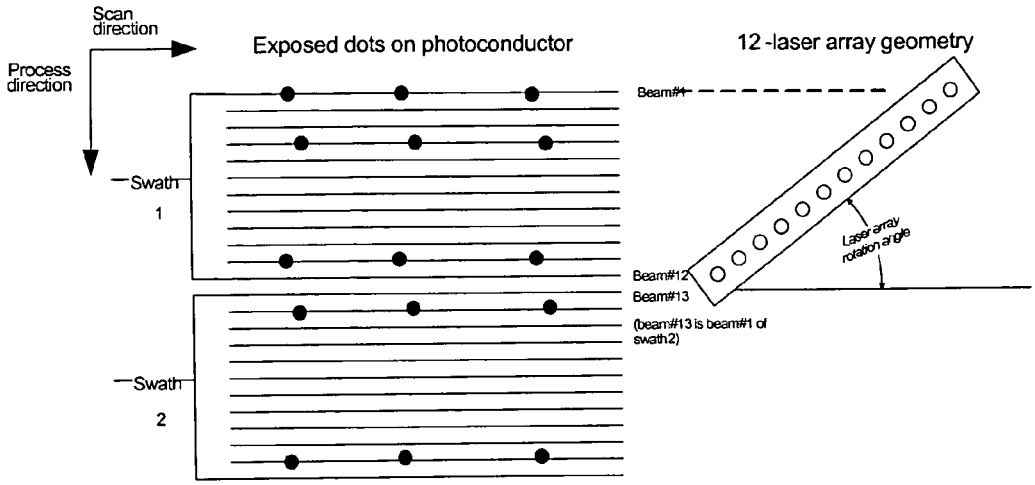
FIG. 1 is a diagram illustrating the operation of a multi-beam laser diode system.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Prior laser printer error correction techniques have used visual evaluations of test patterns to estimate exposure errors introduced by the optical or laser writing head. The end user or administrator physically looked at a printed pattern which is sensitive to errors in the optical write head and then personally determined what corrections should be made. Then the laser printer has been manually programmed with the user determined corrections.

Such visual methods are slow and not repeatable. Manual methods are also dependent on the proper training of the operator or user and provide little accuracy in measuring the deviation. For example, some methods help detect whether an error exists or does not exist but generally provide little guidance as to the quantifiable amount of error that exists.

There are at least two emerging trends that tend to make visual methods less effective. One trend is the use of a higher number of lasers in an optical writing head, where the variations due to a single laser have less visual impact to an individual who views the control image. The availability of VCSEL (Vertical-Cavity Surface-Emitting Laser) arrays makes a large number of lasers more viable. For example, current laser printers may use 12 to 32 lasers on each of its multiple writing heads. The number of lasers on an optical print head is likely to continue to increase.

A second problem is that as image quality increases, smaller errors in the writing head become more significant, and those smaller errors are harder to detect through a visual test. For example, the very fine halftones that are currently desired by end users have a much higher writing head accuracy than the coarser halftones that have been used in the past.

Figure 2A:
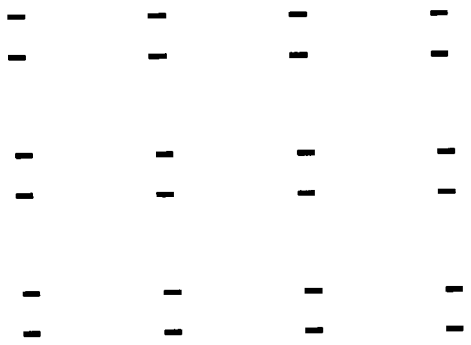
FIG. 2*a* illustrates an example of a vertically aligned dot pattern that may be printed using the beam array in an embodiment of the invention.

A system and method are provided for calibrating a beam array of a printer. The system can include a dot pattern that is printed using the beam array in the printer. FIG. 2*a* illustrates an example dot pattern that may be printed using the beam array. More specifically, a dot pattern is a pattern using dot groups. Dot combinations may also be used such as dot pairs, dot trios, or other discrete dot groups. The dots can be located at certain distances from the top of the page to aid in determining which beam in the writing head is used to expose each dot.

Figure 2B:
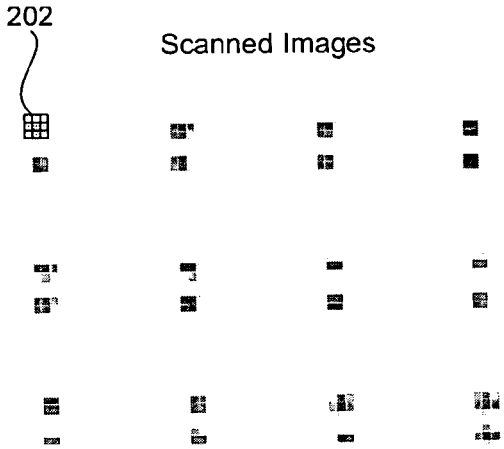
FIG. 2*b* illustrates the scanning of an example aligned dot pattern to find a weighted center in an embodiment of the invention.

An optical scanner can be configured to scan the dot pattern into an electronic file. FIG. 2*b* illustrates that the scan pattern for each dot may result in a 3×3 grid 202 but other grid sizes may result based on the scanner resolution (e.g., 4×4, 5×5, or N×N). The desired granularity for scanning the dot pattern is achieved by using a scanner having 600 dots per inch or greater. Lower scanning resolutions may be used, but less effective correction results may sometimes be the result.

A software module and processor may be in communication with the optical scanner. The software module can be configured to read the electronic file generated by the scanner and calculate distance calibration errors found in the dot pattern. The calculations can take place within a printer or in a hardware and software module that are separate from the printer. For example, an administrator may have the software module loaded on a client computer that is networked with the printer and the calculation may be performed in the client computer.

Once the distance calibration errors have been calculated, then a correction timing signal can be generated. The correction timing signal may be sent from the software module to the printer to correct the distance calibration errors by correcting a timing delay for individual beams in the beam array. The horizontal distance between dots is determined by the delay for the laser control signals. Once the position errors have been determined, the signals can be delayed by the appropriate amount so that the beams on the print head expose the right positions on the printer drum.

An advance correction signal can also be sent to the printer to correct the distance calibration errors by correcting an amount a printer drum advances. In other words, vertical distance calibration errors are corrected by correcting an amount a printing drum advances.

Figure 3:
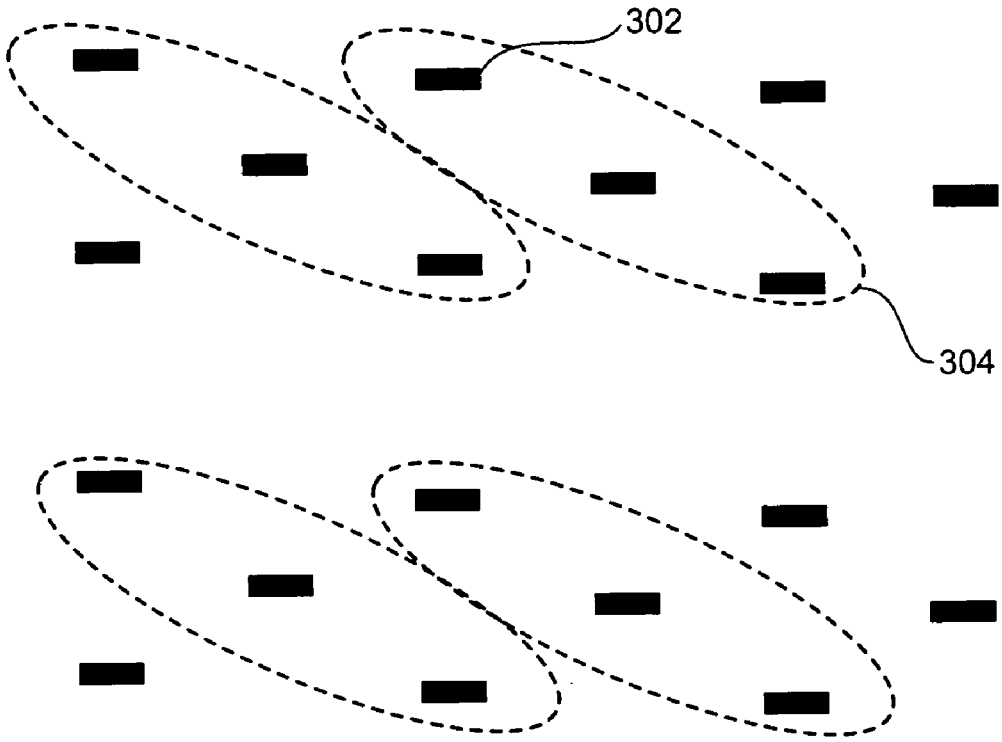
FIG. 3 depicts an additional embodiment of an example pattern that may be printed using 3 offset dots in a group in an embodiment of the invention.

FIG. 3 illustrates an alternative example of a pattern that may be used to calibrate dot alignment. Small dots 302 can be horizontally offset from the other dots in a group 304 and the dot group configurations may be repeated in columns. The software algorithm can then estimate the weighted deviation from the center point. The diameter of the small dot in some embodiments may be approximately 40-100 μm. Other patterns within dot groupings can also be used.

The present system and methods are based on scanning at a moderate resolution image (e.g., 600 dpi) and do not generally use scanner-specific calibration. Thus, these embodiments are resistant to variations in the scanner characteristics.

These described methods and systems can deliver not only qualitative error detection, such as the existence of a certain deviation, but a quantitative estimate of the deviation amount so that it can be corrected. This type of quantitative correction has not been available in the past because an administrator or user would make a rough judgment regarding the amount of error and that decision was subject to human error.

The exemplary systems and methods are automated and do not have the same limitations of the visual methods because the automated methods are repeatable, sensitive, and relatively accurate. Because these systems and methods can use an off-the-shelf scanner, these methods can be used for testing and calibration in the field by repair personnel and others.

In one embodiment of the invention, an inline scanner in the laser printer can be used for scanning the pattern. This allows the scanner to scan a printed pattern immediately after it has been printed. Then the computer software and/or hardware can calculate the appropriate corrections. These corrections may happen with or without user validation and input.

Figure 5:
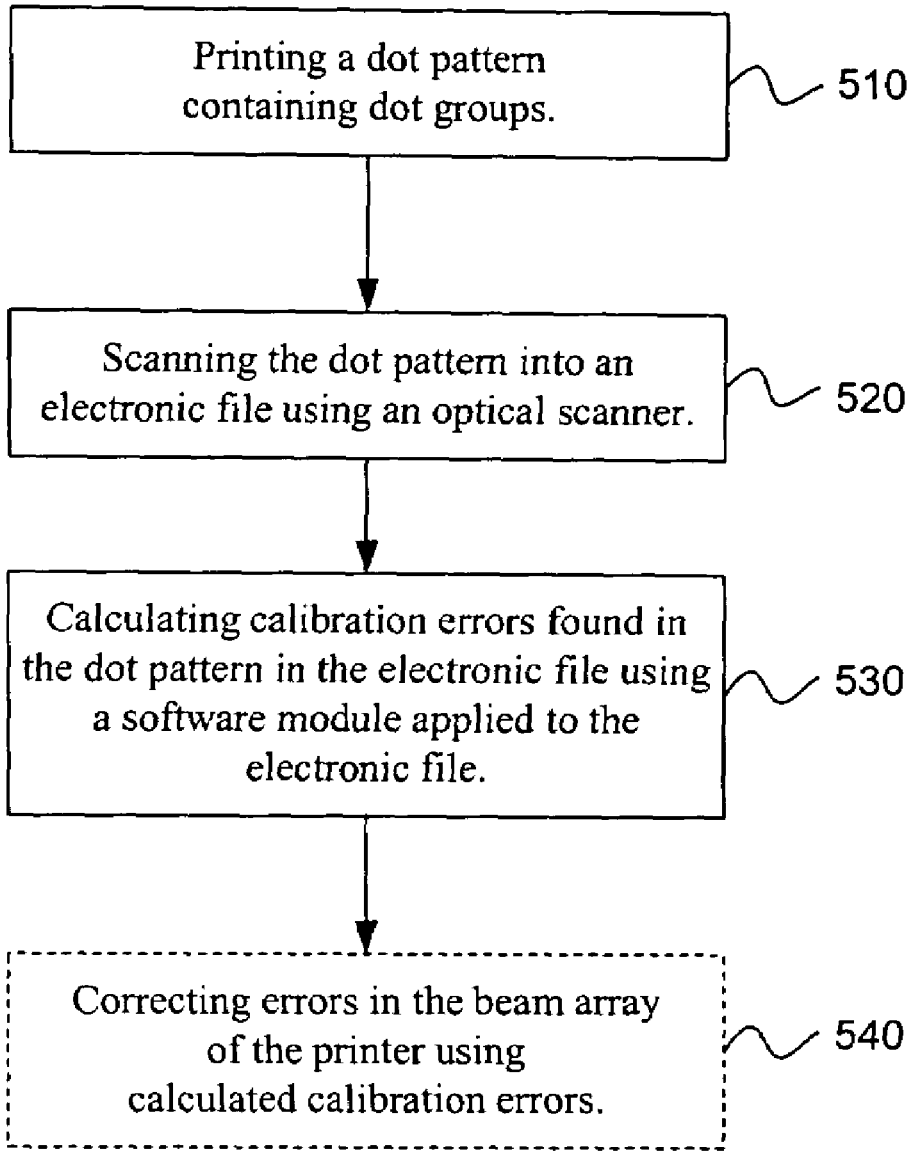
FIG. 5 is a flow chart illustrating a method for calibrating a beam array in a printer in an embodiment of the invention.

A method for calibrating a beam array of a printer is illustrated in FIG. 5. The method can include the operation of printing a dot pattern containing dot groups using the beam array of the printer, as in block 510. The dot groups can be aligned and the dots within a group may be equally spaced from other dots in the group.

Another operation can be scanning the dot pattern into an electronic file using an optical scanner, as in block 520. A further operation is calculating distance calibration errors found in the dot pattern in the electronic file using a software module applied to the electronic file, as in block 530. An optional operation is correcting errors in the beam array of the printer using calculated distance calibration errors, as in block 540. Horizontal distance calibration errors (also called beam skew errors) can be rectified by correcting a timing delay for individual beams in the beam array. Vertical distance calibration errors (also called beam spacing errors) can be corrected by advancing a printing drum a specific amount.

A more detailed example embodiment of the system and method will now be described. The page may be broken into target areas, and each area may contain dots exposed by different beams. For example: one area may contain dots printed with beams 1 and 8, another area may contain dots printed with beams 2 and 8, and so on.

To ensure that each dot is exposed with the intended beam, the dots in the pattern can be positioned at a known distance from the first row of pixels in the page. The printing device has a beam switch capability that automatically selects which beam is used to expose the first row of pixels. The files containing the calibration patterns can be printed while disabling the beam switch capability, so that the first row of pixels is always printed with the first beam in the laser array. It is then possible to determine which beam has been used to expose the pattern dots.

Fiducial marks (e.g., indexing marks) can also be included in the calibration pattern from which the software determines the location of the target areas in the page. So, accurate positioning of the scanned pattern is not as important when such target marks are used.

After the file containing the calibration pattern is printed, then the pattern can be scanned. The printed pattern can be relatively more accurate when the image is saved in a lossless graphics file format, such as a grayscale TIFF. This avoids the problems associated with other more lossy file formats.

While the positioning of the pattern on the scanner is not critical, better measurements can be obtained when there is a reduced amount of scanner skew. This is because scanner skew causes vertical and horizontal lines in the pattern to deviate from vertical and horizontal in the scanned image. The software tools may include skew correction algorithms, but scanner skew can still distort the final measurements. Generally speaking, the printed pattern paper edge can be lined up against the edge of scanner to achieve reasonably useful correction results. The software can also use the fiducial marks to correct skew or to detect and report the scanner skew problem.

When the software module determines the beam skew and beam spacing error, the correction output may be the position of the remainder of the beams (e.g., 2-12) relative to the top-most beam. Another useful metric is the difference between the average spacing of beams, and the spacing between beams 12 of one swath with beam 1 of the next swath. To correct the skew values, the estimated error values are used to determine the delay to apply to each beam to reduce the error or to make error zero. To correct beam spacing, the rotation angle of the laser array can be modified, which is frequently a mechanical adjustment.

Figure 4A:
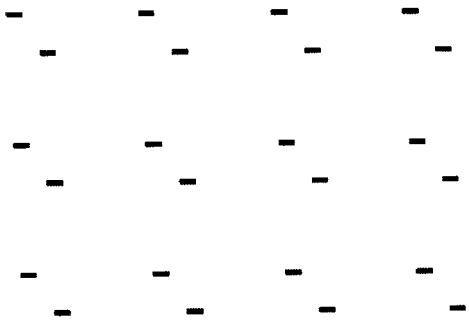
FIG. 4*a* illustrates a dot pattern that is vertically offset and may be printed using the beam array in an embodiment of the invention.
Figure 4B:
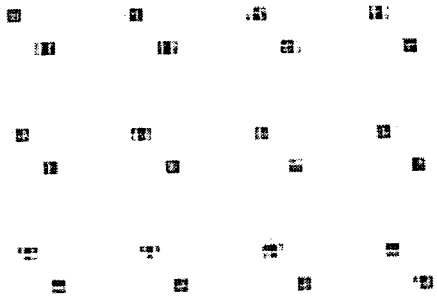
FIG. 4*b* illustrates the scanning of the offset dot pattern to find a weighted center in an embodiment of the invention.

One method for calculating the estimated errors will now be discussed. Each target area in the calibration pattern contains sets of dots printed with two or more different beams. The dots may be vertically aligned or slightly offset as illustrated in FIGS. 4*a* and 4*b*. Beam skew may cause some of the dots to be laterally shifted.

The scanned image can be analyzed to estimate the center of gravity of the dots and the shift between dots in a group or between pairs of dots. Because beam skew is a systematic error across the page, a large number of dots or dot pairs are analyzed to make up for a potentially limited scanner resolution.

The following method can be used to determine the center of gravity of the dots:

1. Find a threshold to separate the dots from the background. The image can be normalized so that the minimum is zero, and the maximum 100. The pixels with a value above 30 are assumed to be part of the background.
2. Locate a pixel which is above threshold.
3. Determine which neighboring pixels are above threshold so they belong to the same cluster
4. Recursively, apply the same algorithm to determine the neighbors of neighbors which belong to the same cluster.
5. Determine the center of gravity by averaging the (x,y) coordinates of all pixels in the cluster, weighed by the intensity of the pixel.

Once the centers of gravity are determined, each cluster can be paired with the neighboring cluster, and the distance between the clusters in the group or pair may be estimated. This distance may be noisy but averaging a large number of clusters for the estimated distance may be accurate to within 1 or 2 microns.

Some dots can be missing, and some debris on the image could be mistakenly interpreted as a dot. If a dot does not have a neighbor within a reasonable distance, the stray dot may be ignored. Ignoring unpaired or ungrouped dots helps reduce the impact of missing dots and false dots.

An example set of calculations for finding the beam skew error will now be discussed. Other known methods for finding a beam skew error can also be used. Let Dij be the estimated distance between beams i and j, computed as the distance between the centers of gravity of a pair or group of clusters. Let xi be the distance between beam i and beam 1, where beam 1 becomes the origin of coordinates:

$$Dij=xi-xj$$

There will be 11 distance values xi, one for each beam, which should match the estimated Dij distances. The problem of finding the optimal xi set can be defined as minimization of the sum of square errors $$R=\sum_{i,j}(Dij-xi+xj)^2$$

The minimum will happen at the point were the partial derivatives $$\frac{\partial R}{\partial xi}=0$$

Given xi, each of the terms in the error function which include Dij or Dki will generate terms in the xi partial derivative of the form:

$$-2*(Dij-xi+xj)+2*(Dki-xk+xi)=0$$

The result is a system of 11 equations because x1 is zero. In this example, the pairs estimated are D(1,8), D(2,9), D(3,10) D(4,11), D(5,12), D(6,1), D(7,2), D(8,3), D(9,4), D(10,5), D(11,6), D(12,7) And the resulting set of linear equations can be solved by the following matrix or the inverse of the linear system matrix:

| | | | | | | | | | | |
|---|---|---|---|---|---|---|---|---|---|---|
| 2.9167 | 0.83333 | 1.75 | 1.6667 | 0.58333 | 2.5 | 0.41667 | 2.3333 | 1.25 | 1.1667 | 2.0833 |
| 0.83333 | 1.6667 | 0.5 | 1.3333 | 0.16667 | 1 | 0.83333 | 0.66667 | 1.5 | 0.33333 | 1.1667 |
| 1.75 | 0.5 | 2.25 | 1 | 0.75 | 1.5 | 0.25 | 2 | 0.75 | 1.5 | 1.25 |
| 1.6667 | 1.3333 | 1 | 2.6667 | 0.33333 | 2 | 0.66667 | 1.3333 | 2 | 0.66667 | 2.3333 |
| 0.58333 | 0.16667 | 0.75 | 0.33333 | 0.91667 | 0.5 | 0.083333 | 0.66667 | 0.25 | 0.83333 | 0.41667 |
| 2.5 | 1 | 1.5 | 2 | 0.5 | 3 | 0.5 | 2 | 1.5 | 1 | 2.5 |
| 0.41667 | 0.83333 | 0.25 | 0.66667 | 0.083333 | 0.5 | 0.91667 | 0.33333 | 0.75 | 0.16667 | 0.58333 |
| 2.3333 | 0.66667 | 2 | 1.3333 | 0.66667 | 2 | 0.33333 | 2.6667 | 1 | 1.3333 | 1.6667 |
| 1.25 | 1.5 | 0.75 | 2 | 0.25 | 1.5 | 0.75 | 1 | 2.25 | 0.5 | 1.75 |
| 1.1667 | 0.33333 | 1.5 | 0.66667 | 0.83333 | 1 | 0.16667 | 1.3333 | 0.5 | 1.6667 | 0.83333 |
| 2.0833 | 1.1667 | 1.25 | 2.3333 | 0.41667 | 2.5 | 0.58333 | 1.6667 | 1.75 | 0.83333 | 2.9167 |

And the solution vector:

$$Si=\sum_{k,j}Dki-Dij$$

This approach can be generalized to situations where there are different numbers of beams or different beams pairs or groups are measured. This calculation method can be made insensitive to scanner skew. If the page is skewed on the scanner, the estimates Dij will include an additional error:

$$D'ij=Dij+Eij$$

The Eij term depends on the vertical distance between beam i and beam j. In particular, if the vertical distances between the dots in a dot pair or dot group are equal, all terms Eij will be equal, so the error does not have impact because the solution vector does not change $$Si=\sum_{k,j} Dki+Eki-Dij-Eij=\sum_{k,j} Dki-Dij$$

If beam pairs or groups are chosen with different spacing, then the solution may be sensitive to scanner skew. To remove skew, an additional term x13 should be computed, which would be the shift from beam number one on a scan to beam number one on the next scan. This shift is due to scanner skew. The mathematical method can be extended to compute this additional term.

The problem of estimating the beam spacing error is similar to the beam skew estimation. Rather than looking at errors in the scan direction, the errors in the process (vertical) direction are evaluated.

In this embodiment, if i<j the distance Dij=xi−xj, as in the previous estimation case. However, if i>j, then beam j belongs to the next swath and the equation has to take into account the gap between beam 12 and beam 13, so that:

$$Dij=xi-x\mathbf{13}-xj \text{ if } i>j$$

Then, the error term is:

$$R=\sum_{i,j,i<j}(Dij-xi+xj)^2+\sum_{i,j,i>j}(Dij-xi+x13+xj)^2$$

If i<j, the partial derivative generates the term:

$$-2*(Dij-xi+xj)+2*(Dki-xk+xi)$$

If i>j the partial derivative for xi has the form:

$$-2*(Dij-xi+xj)-2*(Dij-xi+x\mathbf{13}+xj)$$

And partial derivatives for x13 appear:

$$2*(Dij-xi+x\mathbf{13}+xj)$$

Using the same dot pairs as in the first calculation example: D(1,8), D(2,9), D(3,10) D(4,11), D(5,12), D(6,1), D(7,2), D(8,3), D(9,4), D(10,5), D(11,6), D(12,7), the equation system is solved by the following matrix, which is the inverse of the matrix for the linear system:

| | | | | | | | | | | | |
|---|---|---|---|---|---|---|---|---|---|---|---|
| 2.9184 | 0.83673 | 1.7551 | 1.6735 | 0.59184 | 2.5102 | 0.42857 | 2.3469 | 1.2653 | 1.1837 | 2.102 | 0.020408 |
| 0.83673 | 1.6735 | 0.5102 | 1.3469 | 0.18367 | 1.0204 | 0.85714 | 0.69388 | 1.5306 | 0.36735 | 1.2041 | 0.040816 |
| 1.7551 | 0.5102 | 2.2653 | 1.0204 | 0.77551 | 1.5306 | 0.28571 | 2.0408 | 0.79592 | 1.551 | 1.3061 | 0.061224 |
| 1.6735 | 1.3469 | 1.0204 | 2.6939 | 0.36735 | 2.0408 | 0.71429 | 1.3878 | 2.0612 | 0.73469 | 2.4082 | 0.081633 |
| 0.59184 | 0.18367 | 0.77551 | 0.36735 | 0.95918 | 0.55102 | 0.14286 | 0.73469 | 0.32653 | 0.91837 | 0.5102 | 0.10204 |
| 2.5102 | 1.0204 | 1.5306 | 2.0408 | 0.55102 | 3.0612 | 0.57143 | 2.0816 | 1.5918 | 1.102 | 2.6122 | 0.12245 |
| 0.42857 | 0.85714 | 0.28571 | 0.71429 | 0.14286 | 0.57143 | 1 | 0.42857 | 0.85714 | 0.28571 | 0.71429 | 0.14286 |
| 2.3469 | 0.69388 | 2.0408 | 1.3878 | 0.73469 | 2.0816 | 0.42857 | 2.7755 | 1.1224 | 1.4694 | 1.8163 | 0.16327 |
| 1.2653 | 1.5306 | 0.79592 | 2.0612 | 0.32653 | 1.5918 | 0.85714 | 1.1224 | 2.3878 | 0.65306 | 1.9184 | 0.18367 |
| 1.1837 | 0.36735 | 1.551 | 0.73469 | 0.91837 | 1.102 | 0.28571 | 1.4694 | 0.65306 | 1.8367 | 1.0204 | 0.20408 |
| 2.102 | 1.2041 | 1.3061 | 2.4082 | 0.5102 | 2.6122 | 0.71429 | 1.8163 | 1.9184 | 1.0204 | 3.1224 | 0.22449 |
| 0.020408 | 0.040816 | 0.061224 | 0.081633 | 0.10204 | 0.12245 | 0.14286 | 0.16327 | 0.18367 | 0.20408 | 0.22449 | 0.2449 |

The test pattern may include groups or pairs of dots exposed with different laser beams. Ideally, the vertical distance between the dots should be constant. In practice, there will be small differences depending on which two laser beams are exposing the dots.

This embodiment of a calibration pattern is designed so that both dots are not vertically aligned as illustrated in FIGS. 4*a* and 4*b*. If one dot is directly above the other, the scanner reading for one dot may be affected by the other. This error can move the center of gravity closer to the other dot, resulting in an underestimation of the dot distance. The impact of such an error is not large, but it could be significant because certain embodiments of the method can detect very small errors (less than 1 um). This source or error can be removed by shifting the two dots horizontally.

Differential bow may affect the measurements as well. Differential bow causes the distance between a dot pair or dots in a group to change from left to right. The estimation algorithm takes multiple estimates across the page, so the result averages out the impact of differential bow.

When calculating the beam spacing error in this embodiment, there may be 12 independent variables xi: distance from beam i to beam 1. Note that beam 13 will be the top beam of the next swath. x1 can be zero by definition.

And the solution vector:

$$Si=\sum_{k,j} Dki-Dij \text{ if } 2\le i\le 12$$

$$S13=\sum_{i,j,i>j} Dij$$

This equation system is sensitive to scanner skew. If the scan is tilted, the dots will shift up or down relative to the other dot in the pair or other dots in the group, so that each Dij will include an error term Eij. If the vertical distances between dot pairs or dot groups are constant, then all the Eij are the same.

A method to remove the impact of scanner skew is assuming that x1 is not zero, that is, when the scanner estimates the distance between beam 1 and itself, there is an error due to scanner skew. With this assumption, the error sum becomes:

$$R=\sum_{i,j,i<j}(Dij-xi+x1+xj)^2+\sum_{i,j,i>j}(Dij-xi+x13+xj)^2$$

There are at least two different sources for beam spacing errors. The first is the distance between beams i and i+1 (for 1<=i<=11) which is defined by the position of the emitter within the laser array. The laser array geometry is usually well controlled, so the error is small except for production failures. Another is the distance between beam 12 and beam 13 that is defined by the speed of the photoconductor as it advances under the writing head.

Manufacturing errors can only be fixed by replacing the laser array, but it is an uncommon case. The distance $D_{12,13}$ between beams 12 and 13 can be adjusted by changing the distance between beam 1 and beam 12 so that the distance $D_{12,13}$ equals the average distance of the beams. $D_{1,12}$ is adjusted by tuning the rotation angle of the laser array.

Let $D_{1,13}$ the distance between beam 1 and beam 13 (beam 13 is beam 1 of the second swath). The average distance between two beams is:

$$d=D_{1,13}/12$$

This average distance is determined by the photoconductor rotation speed. This means that the corrected distance between beams 1 and 12 must be set to match this average spacing:

$$Dc_{1,12}=d*11$$

The error in beam spacing is the difference between the corrected distance and the measured distance:

$$E=D_{1,12}-Dc_{1,12}$$

In practice, obtaining an absolute measurement of beam distance $D_{1,12}$ is difficult, so the relative error can be used:

$$Er=(D_{1,12}-Dc_{1,12})/D_{1,12}$$

Which represents the relative amount by which $D_{1,12}$ will be adjusted.

A change in the laser array rotation angle modifies the beam distance to match the corrected value.

Another method for correcting the beam spacing error is modifying the photoconductor rotation speed. The average spacing between the twelve beams on one swath is:

$$d=D_{1,12}/11$$

Now, the distance between the first beam of the last swath and the first beam of the next swath equals the photoconductor advance distance 'A' during the scan time $$D_{1,13}=D_{1,12}+D_{12,13}=A$$

To minimize the error, $D_{12,13}$ must match the average beam spacing. So, the corrected photoconductor advance is Ac $$Ac=D_{1,12}+D_{1,12}/11$$

Which gives us the relative error for photoconductor advance:

$$Er=(A-Ac)/A=(D_{12,13}-D_{1,12}/11)/D_{1,13}$$

The problem of adjusting the photoconductor speed is that it changes the length of the printed image, which in many cases will be unacceptable.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

The invention claimed is:

1. A method for calibrating a beam array of a printer, comprising the steps of:

printing a dot pattern of separate dots using the beam array of the printer;

scanning the dot pattern into an electronic file using an inline optical scanner within the printer, wherein the dot pattern is scanned immediately after printing the dot pattern;

calculating distance calibration errors found in the dot pattern in the electronic file using a software module applied to the electronic file; and correcting horizontal distance calibration errors by generating a correction timing signal to individual beams in the beam array.

2. A method as in claim 1, further comprising the step of correcting errors in the beam array of the printer using the calculated distance calibration errors.

3. A method as in claim 1, further comprising the step of marking the dot pattern with fiducial, wherein the fiducial marks are used to correct scanner skew.

4. A method as in claim 1, wherein the step of printing a dot pattern further comprises the step of printing the dot pattern using vertically aligned dot groups.

5. A method as in claim 1, wherein the step of printing a dot pattern further comprises the step of printing the dot pattern using vertically offset dot groups.

6. A method as in claim 1, further comprising the step of correcting vertical distance calibration errors by correcting an amount a printing drum advances.

7. A method as in claim 1, further comprising the step of using a scanner having 600 dots per inch or greater.

8. A method as in claim 1, wherein the step of calculating distance calibration errors found includes first directly measuring a distance between dots in the dot pattern.

9. A method as in claim 8, wherein the distance measured is measured in pixels.

10. A system for calibrating a beam array of a printer, comprising:

a dot pattern of separate dots that is printed using the beam array in the printer;

an inline optical scanner within the printer configured to scan the dot pattern into an electronic file; and a software module in communication with the optical scanner, the software module being configured to read the electronic file and calculate distance calibration errors found in the dot pattern, wherein a timing correction signal is sent from the software module to the printer to correct the distance calibration errors by generating a correction timing signal for individual beams in the beam array.

11. A system as in claim 10, wherein the dot pattern further comprises dot groups that have dots at pre-defined distances from other dots in the dot group.

12. A system as in claim 10, wherein the dot pattern further comprises vertically aligned dots in a dot group.

13. A system as in claim 10, wherein a correction signal is sent to the printer to correct the distance calibration errors by correcting an amount a printer drum advances.

14. A system as in claim 10, wherein the software module is further directly measure a distance in pixels between dots in the dot pattern.

15. A method for calibrating a beam array of a printer, comprising the steps of:

printing a dot pattern containing dot groups of separate dots;

scanning the dot pattern into an electronic file using an inline optical scanner within the printer, wherein the dot pattern is scanned immediately after printing the dot pattern;

calculating distance calibration errors found in the dot pattern in the electronic file using a software module applied to the electronic file; and correcting errors in the beam array of the printer using calculated distance calibration errors; and correcting horizontal distance calibration errors by generating a correction timing signal to individual beams in the beam array.

16. A method as in claim 15, wherein the step of printing a dot pattern further comprises the step of printing the dot pattern using vertically aligned dots.

17. A method as in claim 15, wherein the step of printing a dot pattern further comprises the step of printing the dot pattern using vertically offset dots.

18. A method as in claim 15, further comprising the step of correcting vertical distance calibration errors by correcting an amount a printing drum advances.

19. A method as in claim 15, further comprising the step of using a scanner having 600 dots per inch or greater.

20. A method as in claim 15, wherein the step of scanning the dot pattern into an electronic file using an optical scanner further comprises the step of scanning the dot pattern into a lossless graphic file format using the optical scanner.

* * * * *

UNITED STATES PATENT AND TRADEMARK OFFICE

CERTIFICATE OF CORRECTION

PATENT NO. : 7,567,267 B2
APPLICATION NO. : 11/496879
DATED : July 28, 2009
INVENTOR(S) : Rodolfo Jodra Barron It is certified that error appears in the above-identified patent and that said Letters Patent is hereby corrected as shown below:

In column 10, line 25, in Claim 3, delete "fiducial," and insert -- fiducial marks, --, therefor.

Signed and Sealed this

Twenty-fourth Day of August, 2010

David J. Kappos

David J. Kappos
*Director of the United States Patent and Trademark Office*